US005664293A

United States Patent [19]

Bartoo

[11] Patent Number: 5,664,293

[45] Date of Patent: Sep. 9, 1997

[54] HOLDER APPARATUS FOR RELEASABLY SUPPORTING AN ELECTRICALLY OPERATED DEVICE

[76] Inventor: Robin L. Bartoo, 499 Embarcadero, Suite 2-16, Oakland, Calif. 94606

[21] Appl. No.: 759,531

[22] Filed: Dec. 4, 1996

[51] Int. Cl.[6] ..... A44B 11/00; A45F 5/00

[52] U.S. Cl. ..... 24/3.12; 24/3.11; 24/67.9; 24/546; 224/929

[58] Field of Search ..... 24/3.12, 3.11, 24/3.1, 67.9, 545, 546, 458; 224/242, 269, 929

[56] References Cited

U.S. PATENT DOCUMENTS

| | | | |
|---|---|---|---|
| 660,990 | 10/1900 | Houghton . | |
| 666,972 | 1/1901 | O'Neal | 24/67.9 |
| 986,854 | 3/1911 | Peck | 24/546 |
| 1,132,912 | 3/1915 | Burgess . | |
| 2,856,666 | 10/1958 | Crothers | 24/546 |
| 4,214,686 | 7/1980 | Dostourian . | |
| 4,627,132 | 12/1986 | Markham . | |
| 4,658,479 | 4/1987 | Sanders . | |
| 4,771,927 | 9/1988 | Ventura . | |
| 4,858,798 | 8/1989 | Siddoway et al. . | |
| 4,887,753 | 12/1989 | Allen | 24/3.11 |
| 5,244,755 | 9/1993 | Benoist et al. . | |

*Primary Examiner*—Victor N. Sakran
*Attorney, Agent, or Firm*—Thomas R. Lampe

[57] ABSTRACT

Holder apparatus for releasably supporting an electrically operated device is formed from a bent wire. The apparatus includes three wire segments for selectively clampingly engaging the belt clip of the device. The holder apparatus serves the dual function of supporting the device and acting as a heat sink to dissipate heat from the device.

10 Claims, 2 Drawing Sheets

HOLDER APPARATUS FOR RELEASABLY SUPPORTING AN ELECTRICALLY OPERATED DEVICE

TECHNICAL FIELD

This invention relates to holder apparatus for releasably supporting a portable electrically operated device having a device body and a belt clip connected to the device body. The invention is applicable, for example, to releasably support hand-held radio/transceiver devices (commonly referred to as "handy talkies"), pagers and the like.

BACKGROUND OF THE INVENTION

Portable electrically operated communication devices such as hand held radio/transceivers and pagers, are finding increasing acceptance by the public. Radio/transceivers are also used extensively by government agencies and other institutions and organizations. Devices of this type commonly employ belt clips which are connected to the body of the device and are utilized to engage belts of users so that they can be readily transported, while allowing the user to quickly remove the device from the belt whenever desired.

While receptacles, e.g. pouches, and other types of holders, such as shelves, have been used to store or hold the devices when not carried on one's person, such arrangements have not generally been satisfactory. First of all, any holder of the receptacle-type which has an interior for receiving the electrically operated device can cause problems. One of these problems is that dissipation of heat from the devices is impeded. Furthermore, such arrangements can be relatively expensive and can restrict ready access to the device when desired. Also, prior art arrangements can fall to firmly position the device and can restrict access to its display, keypad and controls. Of course, any holder covering or even partially covering the speaker of a device employing same can muffle the device. Merely placing such devices on shelves or other support surfaces can be an unsafe practice since the devices may not be protected from impact or other harmful actions. All of these effects can be especially pronounced in moving vehicles.

The following United States patents are directed to holders and supports of various types and are considered to be representative of the present state of the prior art: U.S. Pat. No. 1,132,912 issued Mar. 23, 1915, U.S. Pat. No. 4,214,686 issued Jul. 29, 1980, U.S. Pat. No. 4,858,798 issued Aug. 22, 1989, U.S. Pat. No. 660,990 issued Oct. 30, 1900, U.S. Pat. No. 5,244,755 issued Sep. 14, 1993, U.S. Pat. No. 4,771,927 issued Sep. 20, 1988, U.S. Pat. No. 4,627,132 issued Dec. 9, 1986, and U.S. Pat. No. 4,658,479 issued Apr. 21, 1987.

DISCLOSURE OF INVENTION

The present invention relates to holder apparatus for releasably supporting an electrically operated device which is characterized by its simplicity, low cost and reliability. The device may readily be positioned on the holder apparatus or removed therefrom. Furthermore, the holder apparatus provides a heat path for dissipating heat from the device. That is, the holder apparatus itself and a larger conductive body to which it may be connected operate as a heat sink. The holder apparatus cooperates with the belt clip of the device so that the device body is not covered by the structure of the holder apparatus.

The holder apparatus of the present invention is for releasably supporting an electrically operated device, such as a radio/transceiver device, having a device body and a belt clip connected to the device body.

The holder apparatus is of integral construction and comprises a bent wire. The bent wire includes an elongated base wire segment having first and second ends for securement to a wall or other structure.

The holder apparatus also includes a first wire segment integral with and projecting generally orthogonally from the elongated base wire segment in a first direction at the first end of the elongated base wire segment. The first wire segment forms a first bight.

A second wire segment is integral with the first wire segment and extends from the first wire segment in a second direction substantially opposed to the first direction. The second wire segment extends over the elongated base wire segment and forms a second bight. The first and second bights are located on opposed sides of the elongated base wire segment.

A third wire segment is integral with the second wire segment and extends from the second wire segment in substantially the first direction. The third wire segment forms a third bight located on the same side of the elongated base wire segment as the first bight. The third wire segment is attached to the elongated base wire segment at the second end of the elongated base wire segment.

The belt clip of an electrically operated device releasably supported by the holder apparatus is releasably clampingly engaged by the first, second and third wire segments.

Other features, advantages, and objects of the present invention will become apparent with reference to the following description and accompanying drawings.

BEST MODE FOR CARRYING OUT THE INVENTION

Figure 4:
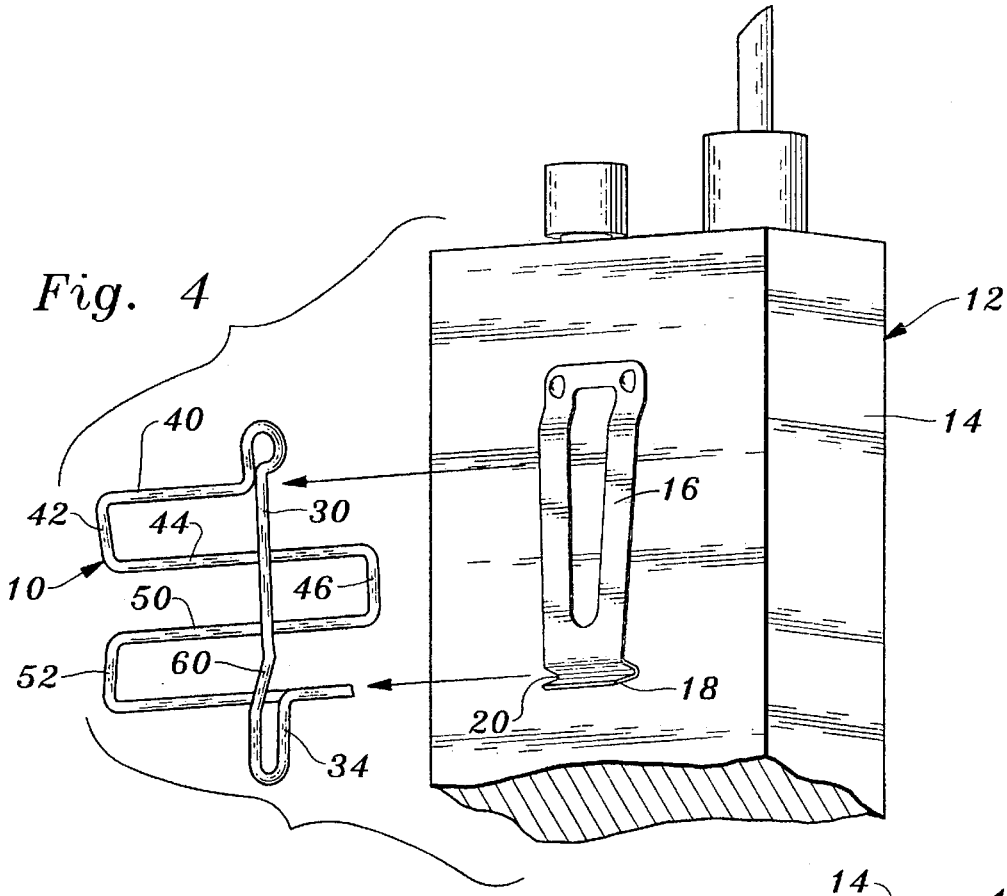
FIG. 4 is a perspective view illustrating the holder apparatus in the process of receiving the belt clip of a radio/transceiver device, the belt clip being attached to the rear or back of the device.

Referring now to the drawings, holder apparatus constructed in accordance with the teachings of the present invention is designated by reference numeral 10. The holder apparatus is for releasably supporting an electrically operated device 12 which in this particular instance is a radio/transceiver device of the type commonly referred to as a "handy talky". However, it is to be understood that the holder apparatus of the present invention may be utilized to releasably support other electrically operated devices such as pagers employing suitable belt clips.

Device 12 includes a device body 14 which is illustrated in somewhat diagrammatic fashion. A belt clip 16 is attached to the device body by any suitable fastener arrangement. The belt clip 16 is of conventional construction and includes a distal end 18 defining a U-bend on groove 20. As is conventional, the belt clip is constructed of metal and is somewhat flexible so that the distal end can be moved away from the device body 14 to receive a belt (not shown).

The apparatus of the present invention is for releasably supporting device 12. The holder apparatus 10 is of integral construction and comprises a metal wire bent to the illustrated configuration.

Figure 5:
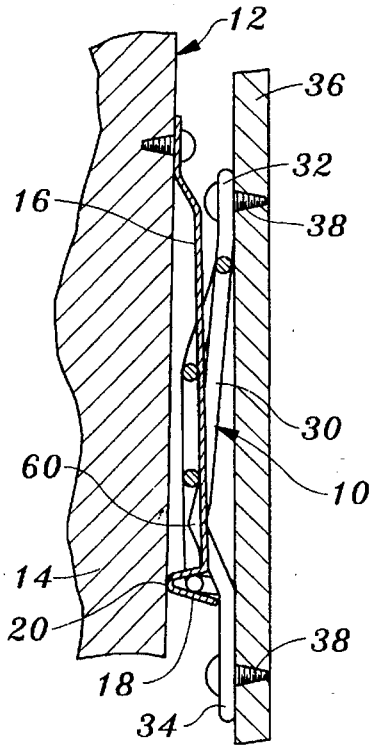
FIG. 5 is a sectional view of the apparatus attached to a wall by mechanical fasteners and holding the electrically operated device, only portions of the wall and device being shown.

The bent wire includes an elongated base wire segment 30 having a first end 32 and a second end 34. The elongated base wire segment is bent at the first and second ends to define openings at the first and second ends for receiving mechanical fasteners employed to secure the holder apparatus to a structure. In FIG. 5, for example, the holder apparatus is secured to a wall 36 by threaded fasteners in the form of wood screws 38.

A first wire segment 40 is integral with and projects orthogonally from the elongated base wire segment in a first direction at the first end 32 of the elongated base wire segment. A first bight 42 is formed by the first wire segment.

A second wire segment 44 is integral with the first wire segment and extends from the first wire segment in a second direction substantially opposed to the first direction. The second wire segment 44 extends over the elongated base wire segment and forms a second bight 46. The first and second bights are located on opposed sides of the elongated base wire segment.

A third wire segment 50 is integral with the second wire segment and extends from the second wire segment in the first direction noted above. The third wire segment forms a third bight 52 located on the same side of the elongated base wire segment as first bight 42. The third wire segment 50 is attached to the elongated base wire segment at the second end 34 of the elongated base wire segment.

The third wire segment 50 also forms a fourth bight 54 spaced from the third bight and located on the same side of the elongated base wire segment as the second bight. The fourth bight 54 extends generally orthogonally relative to the third bight.

The elongated base wire segment 30 has an outwardly projecting bend 60 formed therein between the first and second ends 34, 32.

Figure 6:
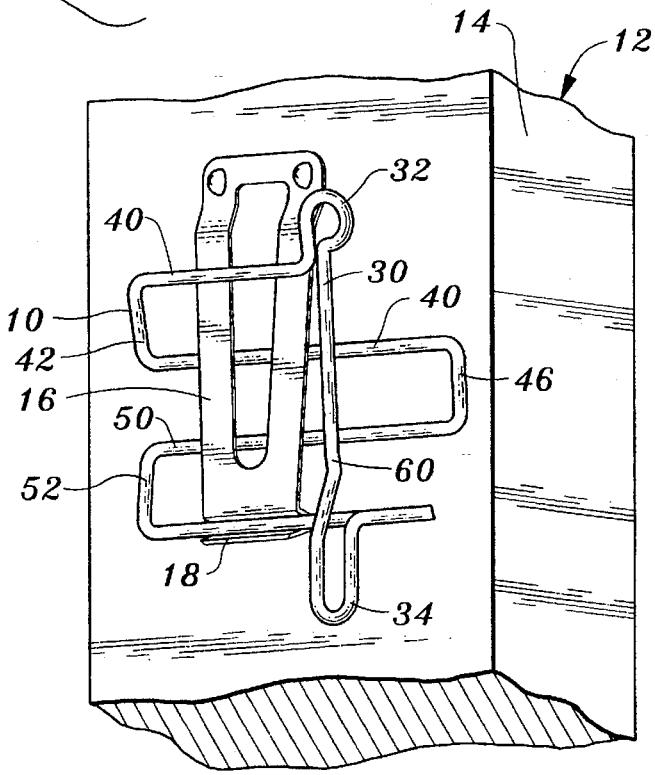
FIG. 6 is a perspective view of the holder apparatus engaging the belt clip of the electrically operated device, only a portion of the electrically operated device being illustrated.
Figure 1:
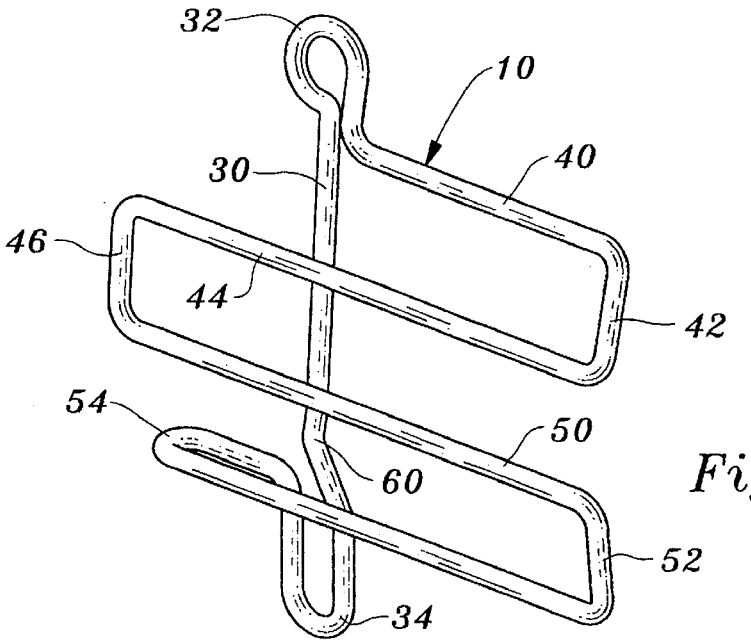
FIG. 1 is a perspective view of holder apparatus constructed in accordance with the teachings of the present invention.
Figure 2:
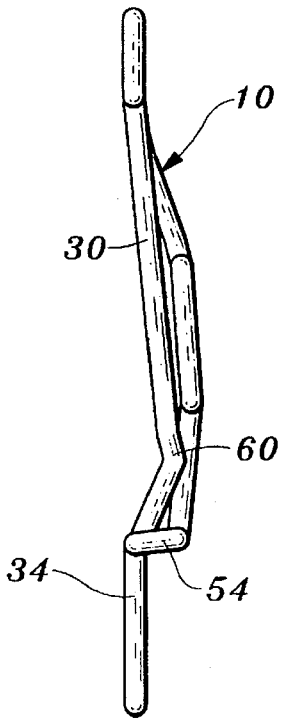
FIG. 2 is a left side view of the holder apparatus.
Figure 3:
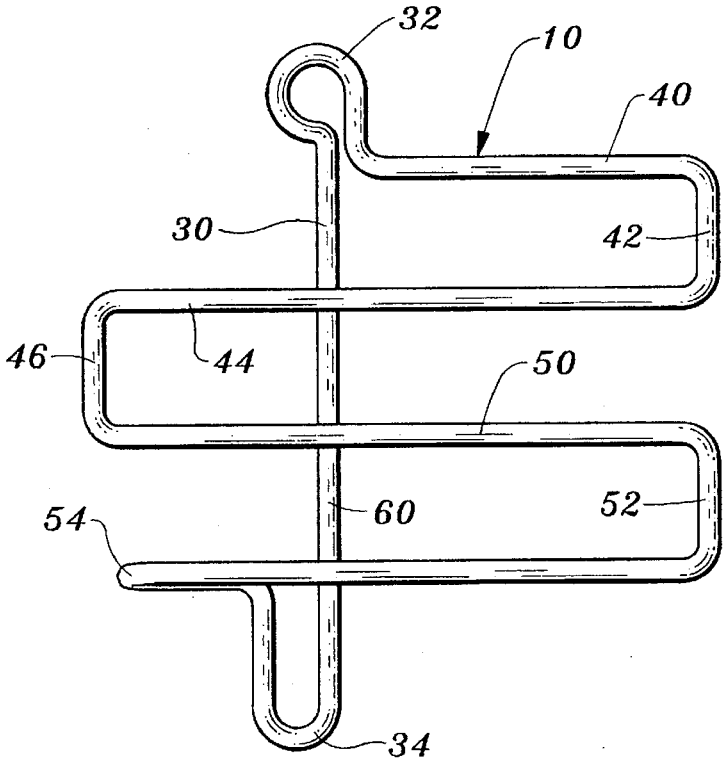
FIG. 3 is a frontal view of the holder apparatus.

Positioning of the device 12 on the holder apparatus 10 so that the device is releasably supported thereby is a simple and straight forward matter. As shown in FIGS. 4–6, the belt clip 16 is slid under second bight 46 past elongated base wire segment 30 until the clip is located between the segment 30 and bights 42, 52. The second wire segment 44 is flexible and the second bight is movable relative to the first and third bights and the elongated base wire segment upon application of external forces to the second bight. During sliding of the belt clip relative to the holder apparatus, a section of third wire segment 50 is disposed in groove 20 of the belt clip.

FIGS. 5 and 6 illustrate the relative positions assumed by the holder apparatus and the belt clip when device 10 is supported by the holder apparatus. Movement of the device is resisted by the holder apparatus when the belt clip is in such position. Engagement between third wire segment 50 and the clip distal end will resist vertical movement of the holder apparatus, and horizontal movement of the device relative to the holder apparatus will be limited due to engagement between the belt clip and the outwardly projecting bend 60 in one direction and engagement between the belt clip and bights 42, 52 in the other direction.

When the device is releasably supported by the holder apparatus, it is clampingly engaged by the first, second and third wire segments and the holder apparatus serves the additional function of acting as a heat sink due to such engagement. Removal of the device from the holder apparatus is accomplished merely by bending second wire segment 44 outwardly and sliding the belt clip between elongated base wire segment 30 and the second wire segment after the belt clip has cleared outwardly projecting bend 60.

I claim:

1. Holder apparatus for releasably supporting an electrically operated device having a device body and a belt clip connected to said device body, said holder apparatus being of integral construction and comprising a bent wire, said bent wire including an elongated base wire segment having first and second ends for securement to a wall or other structure, a first wire segment integral with and projecting generally orthogonally from said elongated base wire segment in a first direction at the first end of said elongated base wire segment and forming a first bight, a second wire segment integral with said first wire segment extending from said first wire segment in a second direction substantially opposed to said first direction, extending over said elongated base wire segment and forming a second bight, said first and second bights being located on opposed sides of said elongated base wire segment, and a third wire segment integral with said second wire segment extending from said second wire segment in substantially said first direction and forming a third bight located on the same side of said elongated base wire segment as said first bight, said third wire segment being attached to said elongated base wire segment at the second end of said elongated base wire segment, the belt clip of an electrically operated device releasably supported by said holder apparatus being releasably clampingly engaged by said first, second and third wire segments.

2. The holder apparatus according to claim 1 wherein said third wire segment forms a fourth bight spaced from said third bight and located on the same side of said elongated base wire segment as said second bight.

3. The holder apparatus according to claim 2 wherein said fourth bight extends generally orthogonally relative to said third bight.

4. The holder apparatus according to claim 1 wherein said bent wire is formed of heat conducting material and wherein said holder apparatus comprises a heat sink for dissipating heat from said electrically operated device.

5. The holder apparatus according to claim 1 wherein said elongated base wire segment is bent at the first and second ends thereof to define openings at said first and second ends for receiving mechanical fasteners for securing said holder apparatus to a structure.

6. The holder apparatus according to claim 1 wherein said second wire segment is flexible and wherein said second bight is movable relative to said first and third bights and said elongated base wire segment upon application of external forces to said second bight.

7. The holder apparatus according to claim 1 wherein said elongated base wire segment has an outwardly projecting bend formed therein between the first and second ends thereof, said outwardly projecting bent being engageable by the belt clip of an electrically operated device releasably supported by said holder apparatus to limit movement of the belt clip and the electrically operated device relative to said holder apparatus.

8. The holder apparatus according to claim 1 wherein said first, second and third wire segments include substantially straight generally parallel wire sections in direct contact with the belt clip of an electrically operated device releasably supported by said holder apparatus.

9. The holder apparatus according to claim 8 wherein said holder apparatus is for releasably supporting an electrically operated device having a device body and a belt clip defining a belt clip groove, one of said substantially straight wire segments being received in the groove of the belt clip of an electrically operated device supported by said holder apparatus to limit movement of the belt clip and the electrically operated device relative to said holder apparatus.

10. The holder apparatus according to claim 1 for releasably supporting an electrically operated radio/transceiver device.

* * * * *